US011851802B2

(12) United States Patent
Dunn et al.

(10) Patent No.: US 11,851,802 B2
(45) Date of Patent: Dec. 26, 2023

(54) COMBINATION SMART DOSE DISPENSER SYSTEM FOR A LAUNDRY TREATMENT APPLIANCE

(71) Applicant: Haier US Appliance Solutions, Inc., Wilmington, DE (US)

(72) Inventors: David Scott Dunn, Louisville, KY (US); Alexander Daniel James, Louisville, KY (US); Kenneth G. Rudolph, Louisville, KY (US); Rainer Schuster, Nurenburg (DE)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/474,192

(22) Filed: Sep. 14, 2021

(65) Prior Publication Data

US 2023/0084319 A1 Mar. 16, 2023

(51) Int. Cl.

| | |
|---|---|
| ***D06F 39/02*** | (2006.01) |
| ***D06F 25/00*** | (2006.01) |
| ***D06F 33/57*** | (2020.01) |
| *D06F 105/42* | (2020.01) |

(52) U.S. Cl.

CPC ..... *D06F 39/022* (2013.01); *D06F 25/00* (2013.01); *D06F 33/57* (2020.02); *D06F 39/028* (2013.01); *D06F 2105/42* (2020.02)

(58) Field of Classification Search

CPC ..... D06F 33/57; D06F 25/00; D06F 39/02; D06F 39/022; D06F 39/028; D06F 2105/42

See application file for complete search history.

(56) References Cited

U.S. PATENT DOCUMENTS

| | | | | |
|---|---|---|---|---|
| 8,950,220 | B2 | 2/2015 | Burgess | |
| 2010/0000578 | A1* | 1/2010 | Hendrickson | D06F 39/022 68/12.18 |
| 2018/0298541 | A1* | 10/2018 | Sasaki | D06F 39/088 |
| 2019/0345661 | A1 | 11/2019 | Ko et al. | |

FOREIGN PATENT DOCUMENTS

| | | | | |
|---|---|---|---|---|
| BR | PI1101037 | A2 * | 5/2013 | |
| WO | WO2019068697 | A1 | 4/2019 | |
| WO | WO-2020052968 | A1 * | 3/2020 | D06F 21/04 |
| WO | WO2020221601 | A1 | 11/2020 | |

OTHER PUBLICATIONS

Machine Translation of Braz et al., PI1101037A2, May 2013. (Year: 2013).*

* cited by examiner

*Primary Examiner* — David G Cormier
(74) *Attorney, Agent, or Firm* — Dority & Manning, P.A.

(57) ABSTRACT

A laundry treatment appliance includes a cabinet forming a receiving space therein, a tub provided within the receiving space, and a dispenser assembly provided within the receiving space, the dispenser assembly being in fluid communication with the tub. The dispenser assembly includes a dispenser body coupled to the cabinet and provided adjacent to the tub, a first drawer slidably inserted into the dispenser body along the transverse direction, and a second drawer slidably inserted into the dispenser body along the transverse direction, the second drawer being provided beneath the first drawer along the vertical direction.

16 Claims, 6 Drawing Sheets

COMBINATION SMART DOSE DISPENSER SYSTEM FOR A LAUNDRY TREATMENT APPLIANCE

FIELD OF THE INVENTION

The present subject matter relates generally to laundry treatment appliances, and more particularly to dispenser systems and assemblies for laundry treatment appliances.

BACKGROUND OF THE INVENTION

Laundry treatment appliances such as combination washing machine and dryer appliances (washer/dryer) generally include a cabinet which receives a tub for containing wash and rinse water to perform a washing operation, or through which air is circulated to perform a drying operation. A wash basket may be rotatably mounted within the wash tub. A drive assembly may be coupled to the wash tub and configured to rotate the wash basket within the wash tub in order to cleanse articles within the wash basket. Upon completion of a wash cycle, a pump assembly can be used to rinse and drain soiled water to a draining system. In some cases, a drying operation may then be performed.

Prior to each wash cycle, cleaning agents such as detergent are added to the wash chamber. Some laundry treatment appliances include large tanks which may be prefilled with cleaning agents such that at the start of each wash cycle, a user need not manually add the cleaning agents. However, some wash operations may require additional cleaning agents (e.g., bleach, sanitizing agents, other additives, etc.) which must be manually added to the wash chamber. Thus, the convenience of the large, prefilled tank is negated by the necessity to manually add the additional cleaning agents.

Additionally or alternatively, in the case of a combination washing machine and dryer, a user must manually add drying additives such as fabric softener prior to commencing the drying operation. Accordingly, a seamless operation of washing and drying cannot be accomplished, causing inconvenience to the user. Accordingly, a laundry treatment appliance that obviates one or more of the above-mentioned drawbacks would be desirable. Moreover, a combination washer/dryer laundry treatment appliance which allows for multiple additions of laundry agents would be particularly beneficial.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a laundry treatment appliance is provided. The laundry treatment appliance may define a vertical direction, a lateral direction, and a transverse direction. The laundry treatment appliance may be configured to perform a washing operation and a drying operation. The laundry treatment appliance may include a cabinet forming a receiving space therein; a tub provided within the receiving space; and a dispenser assembly provided within the receiving space, the dispenser assembly being in fluid communication with the tub. The dispenser assembly may include a dispenser body coupled to the cabinet and provided adjacent to the tub; a first drawer slidably inserted into the dispenser body along the transverse direction; a second drawer slidably inserted into the dispenser body along the transverse direction, the second drawer being provided beneath the first drawer along the vertical direction; and an outlet defined at a lower portion of the dispenser body, wherein contents from each of the first drawer and the second drawer exit the dispenser body via the outlet.

In another exemplary aspect of the present disclosure, a laundry treatment appliance is provided. The laundry treatment appliance may define a vertical direction, a lateral direction, and a transverse direction. The laundry treatment appliance may include a cabinet forming a receiving space therein; a tub provided within the receiving space; and a dispenser assembly provided within the receiving space, the dispenser assembly being in fluid communication with the tub. The dispenser assembly may include a dispenser body coupled to the cabinet and provided adjacent to the tub, the dispenser body having a wedge shape along the transverse direction from a front face toward a rear face thereof; a first drawer slidably inserted into the dispenser body along the transverse direction into the front face; a first supply conduit selectively allowing fluid contained within the first drawer to flow into the dispenser body; a second drawer slidably inserted into the dispenser body along the transverse direction into the front face, the second drawer being provided beneath the first drawer along the vertical direction; and a second supply conduit selectively allowing fluid contained within the second drawer to flow into the dispenser body.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
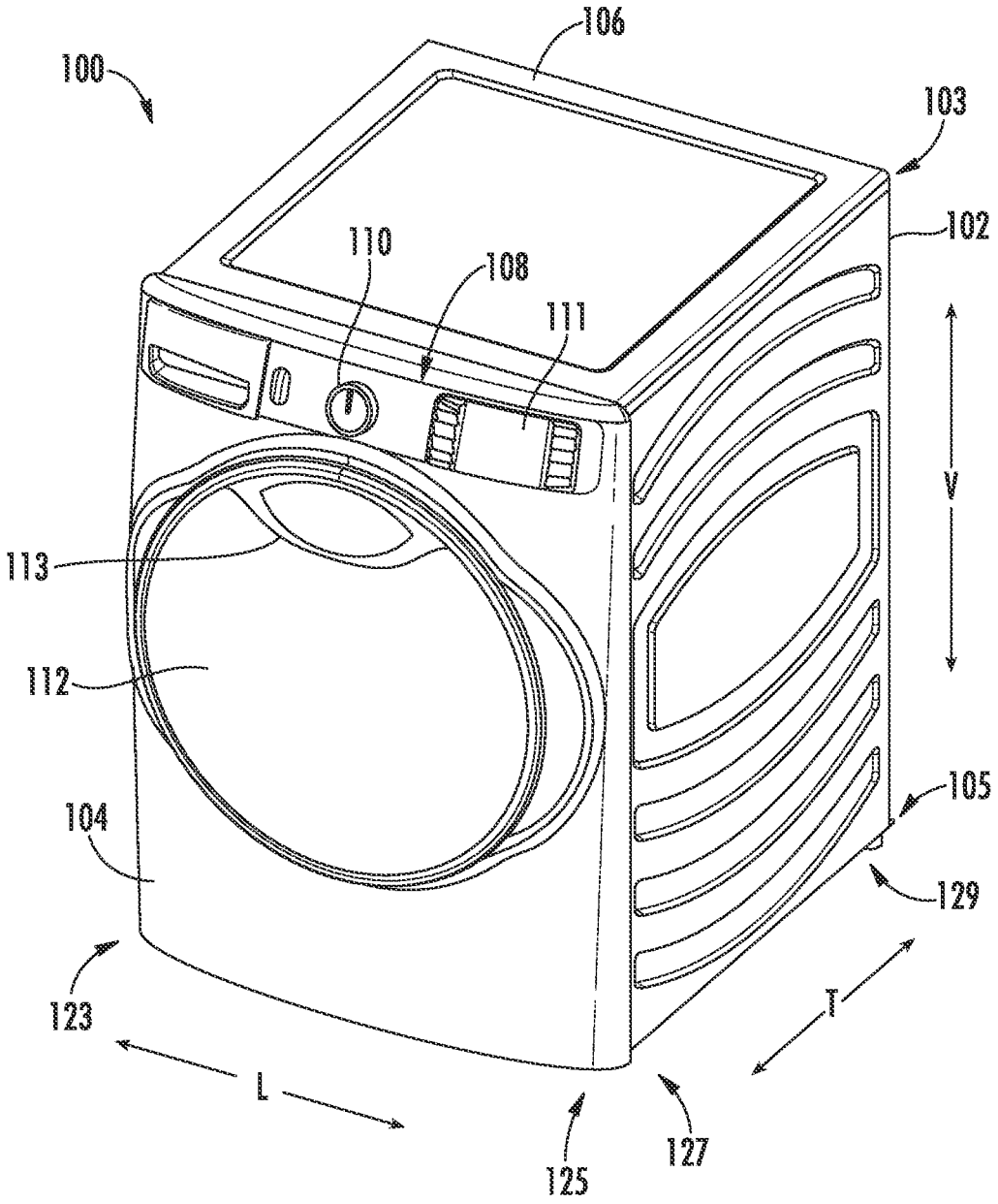
FIG. 1 provides a front perspective view of a laundry treatment appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
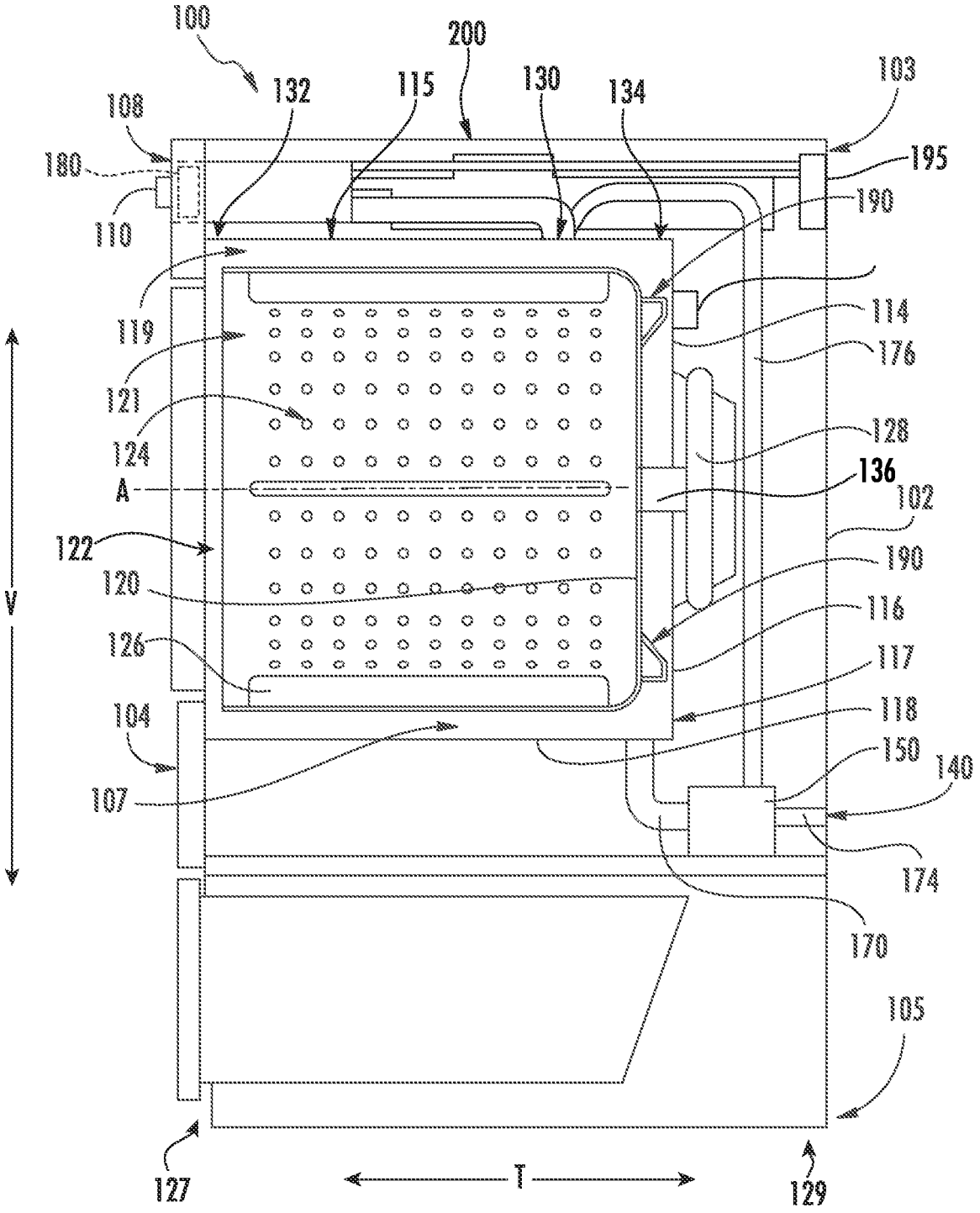
FIG. 2 provides a side schematic view of the exemplary laundry treatment appliance of FIG. 1.

FIGS. 1 and 2 provide various views of an exemplary horizontal axis laundry treatment appliance 100 according to one exemplary embodiment of the present disclosure. For instance, laundry treatment appliance 100 may perform each of a wash cycle or operation and a drying cycle or operation. In particular, FIG. 1 provides a front, perspective view of horizontal axis laundry treatment appliance 100 and FIG. 2 provides a side, section view of laundry treatment appliance 100. As shown in FIG. 1, laundry treatment appliance 100 includes a cabinet 102 that extends between a top 103 and a bottom 105, e.g., along a vertical direction V. Cabinet 102 also extends between a first side 123 and a second side 125, e.g., along a lateral direction L, and between a front 127 and a rear 129, e.g., along a transverse direction T. The vertical, lateral, and transverse directions V, L, T defined by laundry treatment appliance 100 are mutually perpendicular and together define an orthogonal direction system.

Cabinet 102 includes a front panel 104. A door 112 is mounted to front panel 104 and is rotatable between an open position (not shown) facilitating access to a wash drum or basket 120 (FIG. 2) located within cabinet 102, and a closed position (shown in FIGS. 1 and 2) hindering access to basket 120. A user may pull on a handle 113 in order to selectively adjust door 112 between the open and closed positions. Cabinet 102 also includes a top panel 106 positioned at top 103 of cabinet 102.

A control panel 108 including a plurality of input selectors 110 is coupled to front panel 104. Control panel 108 and input selectors 110 collectively form a user interface input for operator selection of machine cycles and features. For example, in some embodiments, control panel 108 includes a display 111 (FIG. 1) configured to present or indicate selected features, a countdown timer, and/or other items of interest to machine users.

As shown in FIG. 2, a tub 114 defines a wash fluid compartment 119 configured for receipt of a washing fluid. Thus, tub 114 is configured for containing washing fluid, e.g., during operation of laundry treatment appliance 100 (e.g., a wash cycle or operation). Washing fluid disposed within tub 114 may include, for example, at least one of water, fabric softener, bleach, and detergent. Tub 114 includes a back wall 116 and a sidewall 118 and extends between a top 115 and a bottom 117, e.g., along the vertical direction V. Further, tub 114 extends between a front 132 and a rear 134, e.g., along the transverse direction T.

Basket 120 is rotatably mounted within tub 114 in a spaced apart relationship from tub sidewall 118 and tub back wall 116. One or more bearing assemblies may be placed between basket 120 and tub 114 and may allow for rotational movement of basket 120 relative to tub 114. Basket 120 defines a wash chamber 121 and an opening 122. Opening 122 of basket 120 permits access to wash chamber 121 of basket 120, e.g., in order to load articles into basket 120 and remove articles from basket 120. Basket 120 also defines a plurality of perforations 124 to facilitate fluid communication between an interior of basket 120 and tub 114. A sump 107 is defined by tub 114 and is configured for receipt of washing fluid during operation of appliance 100. For example, during operation of appliance 100 (e.g., the wash cycle), washing fluid may be urged by gravity from basket 120 to sump 107 through plurality of perforations 124.

A spout 130 is configured for directing a flow of fluid into tub 114. Spout 130 may be in fluid communication with a water supply (not shown) in order to direct fluid (e.g., clean water) into tub 114. A pump assembly 150 (shown schematically in FIG. 2) is located beneath tub 114 for draining tub 114 of fluid. Pump assembly 150 is in fluid communication with sump 107 of tub 114 via a conduit 170. Thus, conduit 170 directs fluid from tub 114 to pump assembly 150. Pump assembly 150 is also in fluid communication with a drain 140 via piping 174. Pump assembly 150 can urge fluid disposed in sump 107 to drain 140 during operation of appliance 100 in order to remove fluid from tub 114. Fluid received by drain 140 from pump assembly 150 is directed out of appliance 100, e.g., to a sewer or septic system.

In addition, pump assembly 150 is configured for recirculating washing fluid within tub 114. Thus, pump assembly 150 is configured for urging fluid from sump 107, e.g., to spout 130. For example, pump assembly 150 may urge washing fluid in sump 107 to spout 130 via hose 176 during operation of appliance 100 in order to assist in cleaning articles disposed in basket 120. It should be understood that conduit 170, piping 174, and hose 176 may be constructed of any suitable mechanism for directing fluid, e.g., a pipe, duct, conduit, hose, or tube, and are not limited to any particular type of mechanism.

A motor 128 is in mechanical communication with basket 120 in order to selectively rotate basket 120, e.g., during an agitation or a rinse cycle of laundry treatment appliance 100 as described below. In particular, a shaft 136 mechanically couples motor 128 with basket 120 and drivingly rotates basket 120 about a shaft or central axis A, e.g., during a spin cycle. Ribs 126 extend from basket 120 into wash chamber 121. Ribs 126 assist agitation of articles disposed within wash chamber 121 during operation of laundry treatment appliance 100. For example, ribs 126 may lift articles disposed in basket 120 during rotation of basket 120.

Also shown in FIG. 2 is a balancing apparatus 190. Balancing apparatus 190 can include a balancing ring, for example. The balancing ring can have an annular cavity in which a balancing material is free to rotate and move about. For example, the balancing material can be a fluid such as water or can be balancing balls. The balancing ring can include one or more interior baffles. Although a single balancing ring or apparatus 190 is shown in FIG. 2, any number of such rings or apparatuses can be included in laundry treatment appliance 100 and can be placed according to any known or desirable configuration. For example, two balancing rings may be respectively placed at the front and back of basket 120.

As further shown in FIG. 2, laundry treatment appliance 100 includes a dispenser assembly 200. Dispenser assembly 200 includes features for receiving various wash treatment additives (e.g., fluid detergent, powder detergent, fabric softener, bleach, powder or any other suitable liquid) and dispensing or directing them to wash fluid compartment 119 of tub 114 during operation of laundry treatment appliance 100. Dispenser assembly 200 will be described in further detail below. For instance, dispenser assembly 200 may include two drawers, each drawer configured to store one or more of the various wash treatment additives. In detail, one or more of the additives may be added during either or both of a wash cycle and a drying cycle.

Operation of laundry treatment appliance 100 may be controlled by a processing device or controller 180 that is operatively coupled to control panel 108 for user manipulation to select washing and/or drying cycles and features. In response to user manipulation of control panel 108, controller 180 may operate the various components of laundry treatment appliance 100 to execute selected machine cycles and features.

Controller 180 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 180 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 108 and other components of laundry treatment appliance 100 may be in communication with controller 180 via one or more signal lines or shared communication busses.

In an illustrative example of operation of laundry treatment appliance 100, laundry items are loaded into basket 120, and washing operation is initiated through operator manipulation of input selectors 110. Tub 114 is filled with water and one or more wash treatment additives from dispenser assembly 200 to form a wash fluid. One or more valves of a water inlet valve 195 can be actuated by controller 180 to provide for filling tub 114 to the appropriate level for the amount of articles being washed. Water inlet valve 195 is in fluid communication with a water source, such as e.g., a hot water heater and/or a municipal water line. Once tub 114 is properly filled with wash fluid, the contents of basket 120 are agitated with ribs 126 for cleansing of laundry items in basket 120.

After the agitation phase of the wash cycle is completed, tub 114 is drained. Laundry articles can then be rinsed by again adding wash fluid to tub 114 depending on the particulars of the cleaning cycle selected by a user, and ribs 126 may again provide agitation within wash chamber 121. One or more spin cycles may also be used. In particular, a spin cycle may be applied after the wash cycle and/or after the rinse cycle in order to wring wash fluid from the articles being washed. During a spin cycle, basket 120 is rotated at relatively high speeds.

Upon completion of the wash cycle, laundry treatment appliance 100 may perform a drying cycle. For instance, after the spin cycle is completed and excess wash fluid and/or water has been drained from the tub, laundry treatment appliance may begin the drying cycle (e.g., circulating air through tub 114 and/or wash chamber 121). The drying cycle may be performed automatically upon completion of the wash cycle, or may be initiated separately by the user upon the completion of the wash cycle. In at least one embodiment, the drying cycle commences automatically within a predetermined amount of time after the completion of the wash cycle (e.g., by utilizing additives provided in one of the two drawers of dispenser assembly 200, described below).

While described in the context of a specific embodiment of horizontal axis laundry treatment appliance 100, it will be understood that horizontal axis laundry treatment appliance 100 is provided by way of example only. Other laundry treatment appliances having different configurations, different appearances, and/or different features may also be utilized with the present subject matter as well, including, for example, vertical axis laundry treatment appliances. Thus, the teachings of the present disclosure are not limited to use with laundry treatment appliance 100.

Turning now to FIGS. 3 through 9, a dispenser assembly 200 according to one or more embodiments of the present disclosure will be described in detail. According to the present disclosure, the described dispenser assembly may be incorporated into a variety of laundry treatment apparatuses. For instance, dispenser assembly 200 may be installed within a combination washing machine and dryer. Advantageously, the features of the described dispenser assembly may allow for a seamless performance of both a washing operation and a drying operation. However, additional uses will be apparent to one having ordinary skill in the art.

Dispenser assembly 200 may include a dispenser body 202. Dispenser body 202 may be a housing or frame member configured to be installed within cabinet 102 of laundry treatment appliance 100. For instance, dispenser body 202 may be installed at or near top 103 of cabinet 102, adjacent to opening 122. Additionally or alternatively, dispenser assembly 200 may be provided at or near a side of cabinet 102 (e.g., first side 123, second side 125). Dispenser body 202 may be in fluid communication with wash tub 114. For instance, a tube or pipe (e.g., tub supply conduit 380, described in more detail below) may connect dispenser body 202 to wash tub 114. Water and/or one or more fluid additives may flow from dispenser body 202 through tub supply conduit 380 (FIG. 8) into wash tub 114 to perform a laundry operation. As will be explained in more detail below, a single outlet 220 may be formed in dispenser body 202 through which contents of two separate drawers (and/or tanks) may flow into wash tub 114.

Dispenser body 202 may have a predominantly triangular cross-section (e.g., in the vertical direction V and transverse direction T). For instance, dispenser body 202 may define a front face 204 and a rear face 206 opposite the front face 204 along the transverse direction T. In some embodiments, the front face 204 is predominantly parallel with front panel 104 of laundry treatment appliance 100. Thus, dispenser body 202 may present a seamless appearance together with front panel 104. Front face 204 may be larger than rear face 206. For instance, a length 208 along the vertical direction V of front face 204 may be greater than a length 210 along the vertical direction V of rear face 206. Advantageously, dispenser body 202 may fit within cabinet 102 together with wash tub 114 and any additional air ducts (e.g., as may be required for a drying operation).

Figure 3:
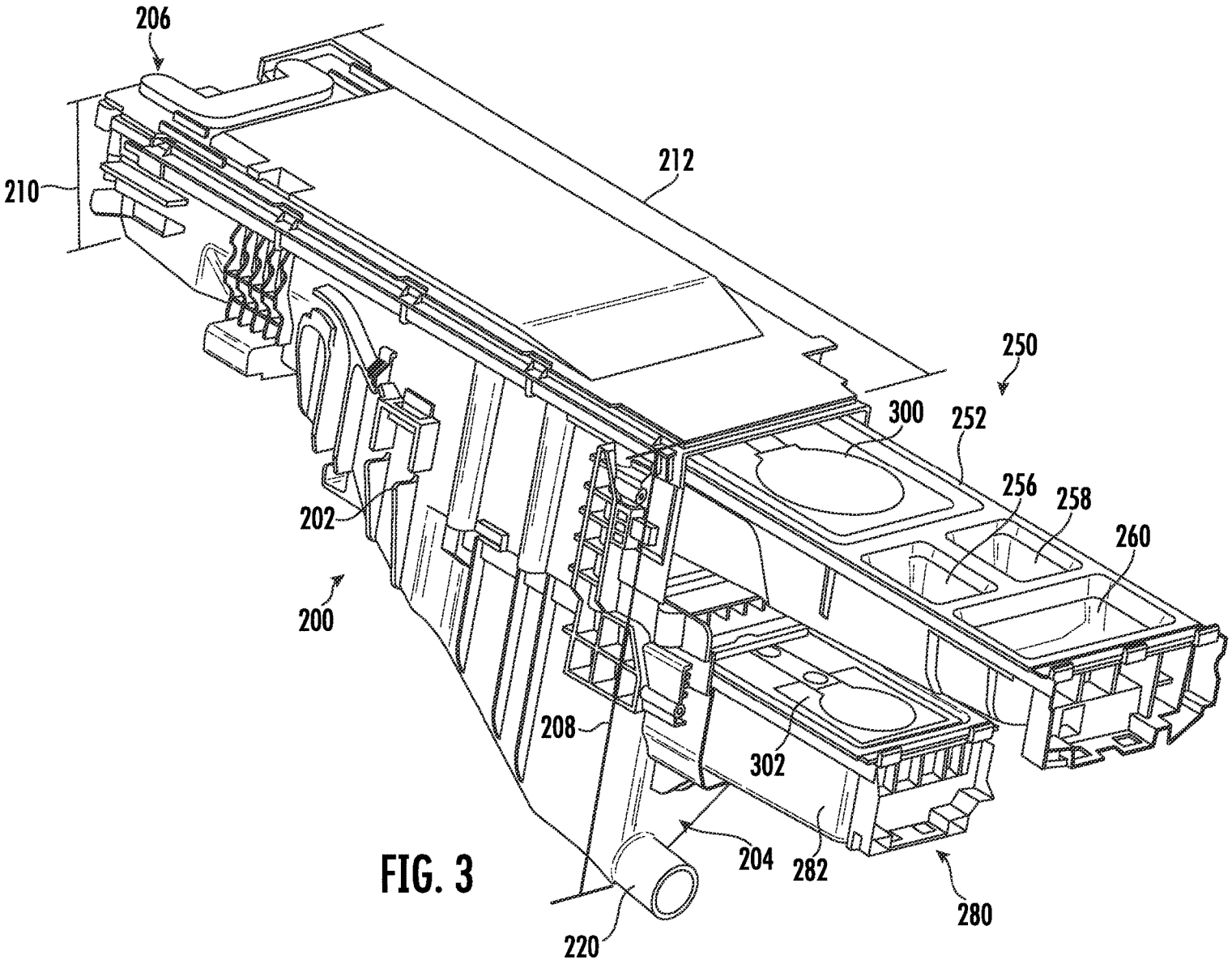
FIG. 3 provides a perspective view of a dispenser assembly according to exemplary embodiments of the present disclosure.

The elongated front face 204 of dispenser body 202 allows for a plurality of drawers to be inserted therein. For instance, dispenser assembly 200 may include a first drawer 250 (or first drawer assembly) and a second drawer 280 (or second drawer assembly). Each of first drawer 250 and second drawer 280 may be slidably received within dispenser body 202. For instance, each of first drawer 250 and second drawer 280 may be selectively withdrawn from front face 204 of dispenser body 202 (e.g., along the transverse direction T). Thus, each of first drawer 250 and second drawer 280 may be movable between a withdrawn or extended position (e.g., as shown in FIG. 3) and a retracted position (e.g., retracted into dispenser body 202) along the transverse direction T.

In the withdrawn position, first drawer 250 and/or second drawer 280 may be at least partially withdrawn from dispenser body 202 so that a user may readily access one or more additive compartments of first drawer 250 or second drawer 280, e.g., to fill one of the compartments with an additive. In the retracted position, first drawer 250 and/or second drawer 280 is received within dispenser body 202, e.g., so that one or more of the additive compartments of first drawer 250 or second drawer 280 are in fluid communication with a water inlet valve (e.g., water inlet valve 195 described below) and wash tub 114 during operation of laundry treatment appliance 100.

Figure 4:
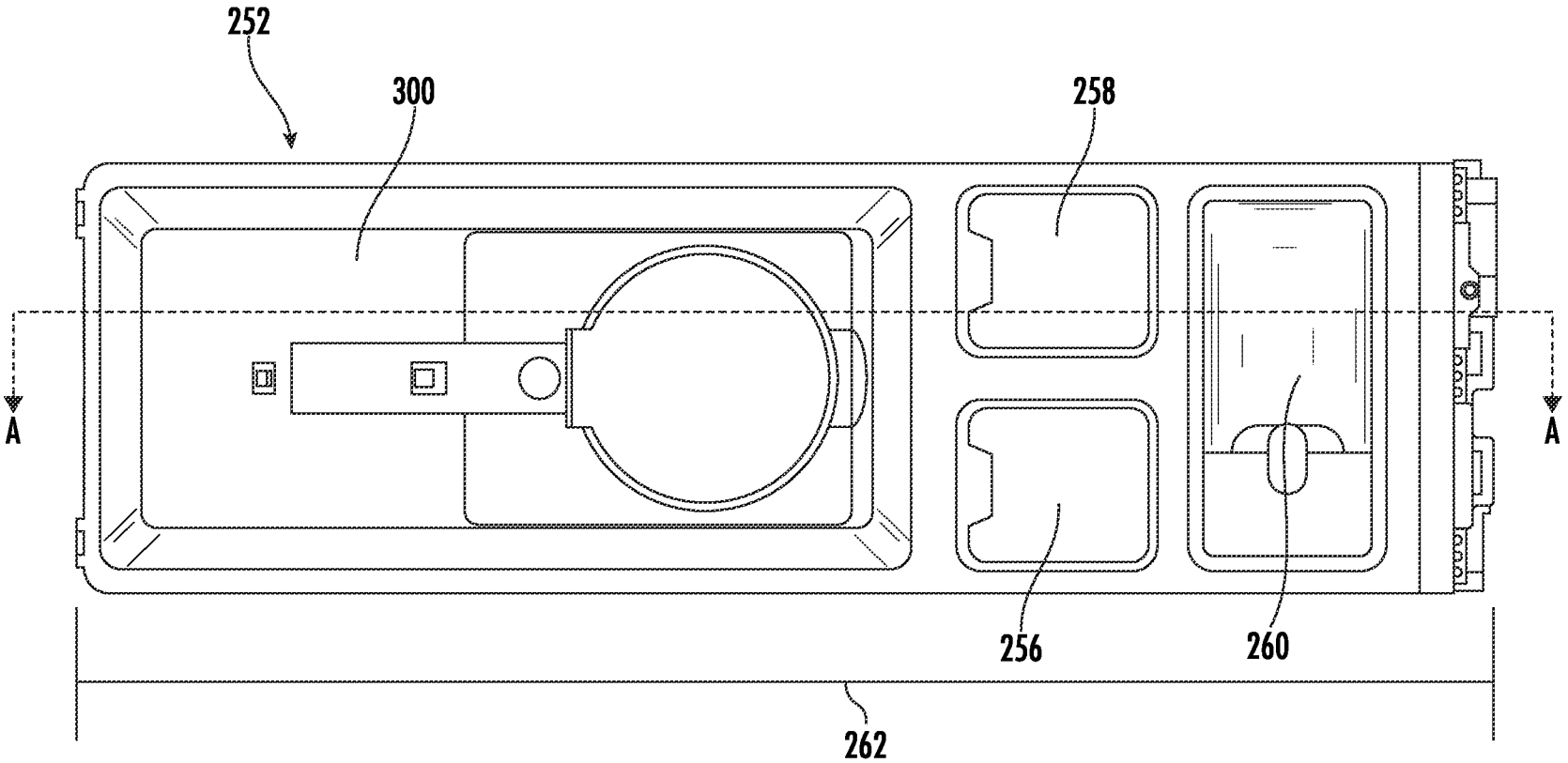
FIG. 4 provides a top view of an exemplary drawer of the dispenser assembly of FIG. 3.

First drawer 250 may include a first drawer body 252. First drawer body 252 may define a plurality of additive compartments. In particular, as shown best in FIG. 4, first drawer body 252 may define a first additive compartment 256, a second additive compartment 258, and a third additive compartment 260. First additive compartment 256 may be a powder detergent compartment, second additive compartment 258 may be a liquid softener compartment, and third additive compartment 260 may be a liquid bleach compartment. As such, first additive compartment 256 may be configured to receive a powder detergent. Second additive compartment 258 may be configured to receive a liquid softener and may be provided adjacent to first additive compartment 256, e.g., along the lateral direction L. First additive compartment 256 and second additive compartment 258 may have similar shapes and volumes, e.g., as shown in FIG. 4. Third additive compartment 260 may be configured to receive a liquid bleach and may be defined within first drawer body 252 in front of first additive compartment 256 and second additive compartment 258, e.g., along the transverse direction T. Third additive compartment 260 may be positioned generally along a front of first drawer body 252. In alternative embodiments, the additive compartments may have other suitable configurations and may be configured to receive different additives.

First drawer body 252 may have a first length 262. First length 262 of first drawer body 252 may be a predetermined percentage of a length 212 of dispenser body 202 along the transverse direction T. For instance, first length 262 may be between about 70% and about 90% of length 212 of dispenser body 202. Thus, first drawer body 252 may occupy a majority of length 212 of dispenser body 202 (e.g., in the retracted position).

Figure 5:
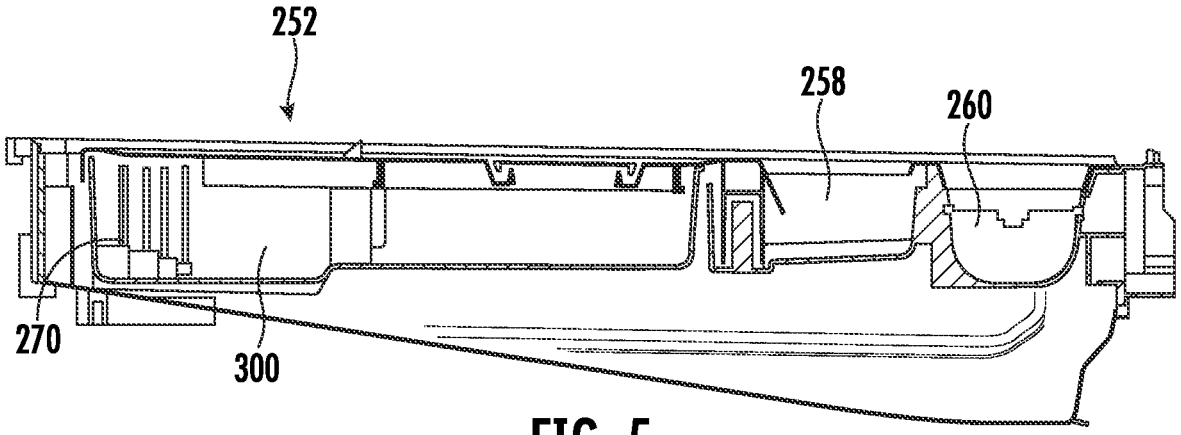
FIG. 5 provides a side schematic view of the exemplary drawer of FIG. 4.

As shown in FIGS. 4 and 5, first drawer body 252 may include a first tank 300 configured to receive a fluid additive, such as e.g., a liquid detergent. In detail, first tank 300 may be nested within first drawer body 252. First tank 300 may be spaced from first additive compartment 256 and second additive compartment 258, e.g., along the transverse direction T. For instance, first tank 300 may be provided behind the additive compartments along the transverse direction T. First drawer body 252 may include a partition wall that partitions first tank 300 from first additive compartment 256 and second additive compartment 258. As such, in some embodiments, first tank 300 is not in liquid communication with first additive compartment 256, second additive compartment 258, or third additive compartment 260. Access to first tank 300 may be provided by an access member (or door), which may be rotatably hinged to a top wall of first tank 300 (or a top of first drawer body 252) as shown in FIG. 4. In alternative exemplary embodiments, the access member may be other suitable types of members that provide selective access to first tank 300. For instance, the access member may be a sliding door that slides along the transverse direction T to provide selective access to first tank 300.

In some embodiments, for instance, first tank 300 is sized to hold about fifty fluid ounces (50 fl. oz.) of a fluid additive. However, it should be noted that first tank 300 may be sized to appropriately accommodate any suitable amount of fluid additive. The large capacity of first tank 300 may allow a user to run a multitude or plurality of wash cycles without need to refill the tank after each cycle. This may, for example, reduce a user's manual efforts of pouring, measuring, and filling the tank for a particular laundry load. For example, a user may execute wash cycles under normal conditions for two to four (2-4) months without need to refill first tank 300 with a new supply of fluid additive. As will be explained further herein, in some exemplary embodiments, the amount of fluid additive directed from first tank 300 to tub 114 may be controlled, e.g., based upon the cycle selected and by controlling water inlet valve 195.

Dispenser assembly 200 may include a first supply conduit 270 in fluid communication with first tank 300. First supply conduit 270 may selectively allow fluid contained within first tank 300 (or one of the additive compartments) to flow into dispenser body 202. For instance, in some embodiments, first supply conduit 270 may be a tube or pipe provided at or near a bottom of first drawer body 252. Thus, before or during a laundry operation, a predetermined amount of additive may be supplied to tub 114 (e.g., together with water). As will be described in more detail below, first supply conduit 170 may include a Venturi device (or Venturi nozzle) to aid in supplying precise amounts of additive to tub 114.

Dispenser assembly 200 may include the second drawer 280. Second drawer 280 may be provided adjacent to first drawer 250. For instance, second drawer 280 may be located beneath first drawer 250 along the vertical direction V. It should be noted that a location of second drawer 280 with respect to first drawer 150 may be altered according to specific embodiments. As discussed above, second drawer may be slidably inserted to dispenser body 202 (e.g., along the transverse direction T). Further, as will be explained in more detail below, one or both of first drawer 250 and second drawer 280 may be used during the wash cycle, the drying cycle, or both the wash and the drying cycle, according to specific embodiments.

Second drawer 280 may include a second drawer body 282. Second drawer body 282 may have a second length 264 (e.g., along the transverse direction T). Second length 264 may be shorter than first length 262. Accordingly, second drawer body 282 may be smaller than first drawer body 252. As discussed above, dispenser body 202 may have a predominantly triangular cross section in the plane defined along the vertical direction V and transverse direction T. In detail, as best shown in FIG. 3, a bottom face of dispenser body 202 may slope downward from rear face 206 to front face 204. Accordingly, second drawer body 282 may be sized accordingly to avoid interference with the bottom face of dispenser body 202 when in the retracted position.

Figure 6:
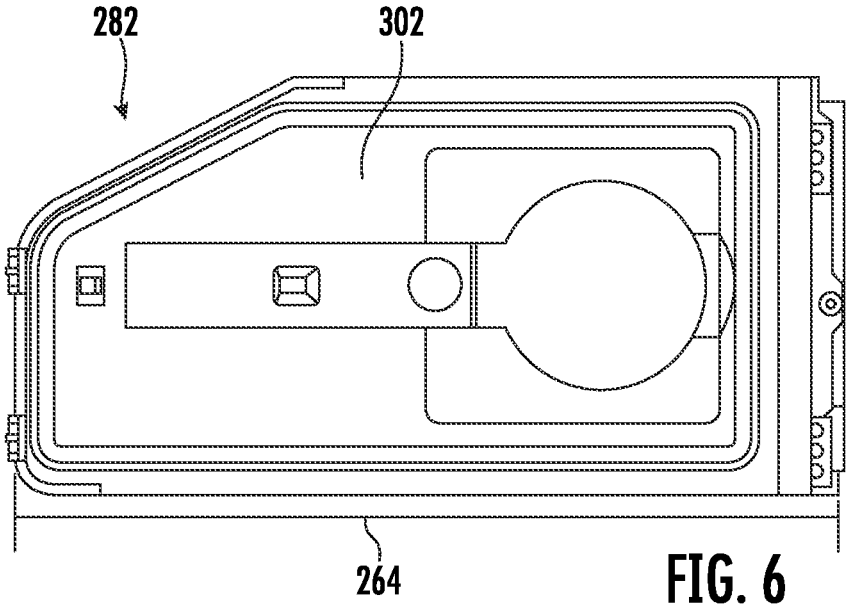
FIG. 6 provides a top view of another exemplary drawer of the dispenser assembly of FIG. 3.
Figure 7:
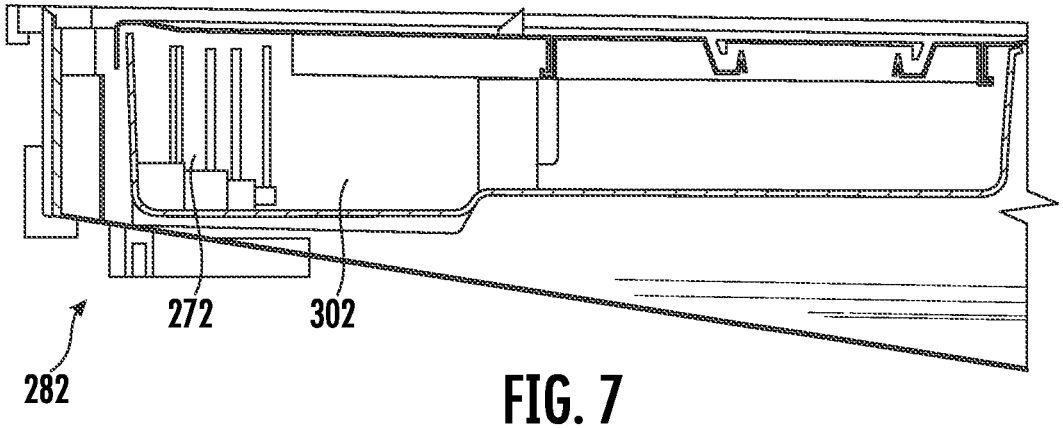
FIG. 7 provides a side schematic view of the exemplary drawer of FIG. 6.

Second drawer body 282 may include a second tank 302 configured to receive a fluid additive. In detail, second tank 302 may be nested within second drawer body 282. Second tank 302 may be smaller than first tank 300. For instance, second tank 302 may have a second volume less than the first volume of first tank 300. Similar to first tank 300, access to second tank 302 may be provided by an access member (or door), which may be rotatably hinged to a top wall of second tank 302 (or a top of second drawer body 282) as shown in FIG. 6. In alternative exemplary embodiments, the access member may be other suitable types of members that provide selective access to second tank 302. For instance, the access member may be a sliding door that slides along the transverse direction T to provide selective access to second tank 302.

In some embodiments, for instance, second tank 302 is sized to hold about 32 fluid ounces (32 fl. oz.) of an additive (e.g., a fluid additive). However, it should be noted that second tank 302 may be sized to appropriately accommodate any suitable amount of additive. The capacity of second tank 300 may allow a user to run a multitude or plurality of laundry (e.g., wash or dry) cycles without need to refill the tank after each cycle. This may, for example, reduce a user's manual efforts of pouring, measuring, and filling the tank for a particular laundry load. As will be explained further herein, in some exemplary embodiments, the amount of fluid additive directed from second tank 302 to tub 114 may be controlled, e.g., based upon the cycle selected and by controlling water inlet valve 195.

According to some embodiments, laundry treatment apparatus 100 may perform each of a washing operation and a drying operation (e.g., as a combination laundry treatment appliance). Thus, second tank 302 may be configured to store certain additives that are dispensed during a drying operation (e.g., fabric softener, scent additives, etc.). Advantageously, a user may need only input one command to perform both a washing operation and a drying operation without requiring interaction between each operation. In detail, controller 180 may be configured to operate a pump (described below) to supply one or more additives (e.g., together with water) from first drawer 250 to tub 114 during a washing operation. Additionally or alternatively, controller 180 may be configured to operate the pump to supply an additive from second drawer 280 before or during a drying operation. Thus, a seamless dual wash/dry operation may be carried out without the need for a user interaction between operations. Further, operation of the pump or pumps may be controlled (e.g., by controller 180) according to a predetermined schedule. For instance, controller 180 may operate a first pump associated with first drawer 250 at a first predetermined time (e.g., during the washing operation). Subsequently, controller 180 may operate a second pump associated with second drawer 280 at a second predetermined time after the first predetermined time (e.g., during the drying operation). The predetermined schedule may be input by the user, or may be preprogrammed into controller 180. In detail, an operation of the second pump may be delayed with respect to an operation of the first pump. Thus, additives provided in second drawer 280 may be released separately from additives provided in first drawer 250 (e.g., on a delayed schedule).

Dispenser assembly 200 may include a second supply conduit 272 in fluid communication with second tank 302. Second supply conduit 272 may selectively allow fluid contained within second tank 302 to flow into dispenser body 202. For instance, in some embodiments, second supply conduit 272 may be a tube or pipe provided at or near a bottom of second drawer body 282. Thus, before or during a laundry operation, a predetermined amount of additive may be supplied to tub 114 (e.g., together with water, in some embodiments). As will be described in more detail below, second supply conduit 172 may include a Venturi device (or Venturi nozzle) to aid in supplying precise amounts of additive to tub 114.

The additive supplied from either first drawer 250 or second drawer 280 may be introduced to tub 114 via outlet 220. Advantageously, only a single connection between dispenser assembly 200 and tub 114 is required, increasing functionality, reducing assembly time, and reducing potential failure points resulting in less maintenance. As described above, outlet 220 may be provided at or near a bottom of dispenser body 202. Further, outlet 220 may be provided at front face 204 of dispenser body 202. Since, as described above, dispenser body 202 has a triangular cross-section, the bottom of front face 204 may be a low point within dispenser body 202. Accordingly, the contents of each of first drawer 250 and second drawer 280 may easily and naturally flow into tub 114 via outlet 220.

Figure 8:
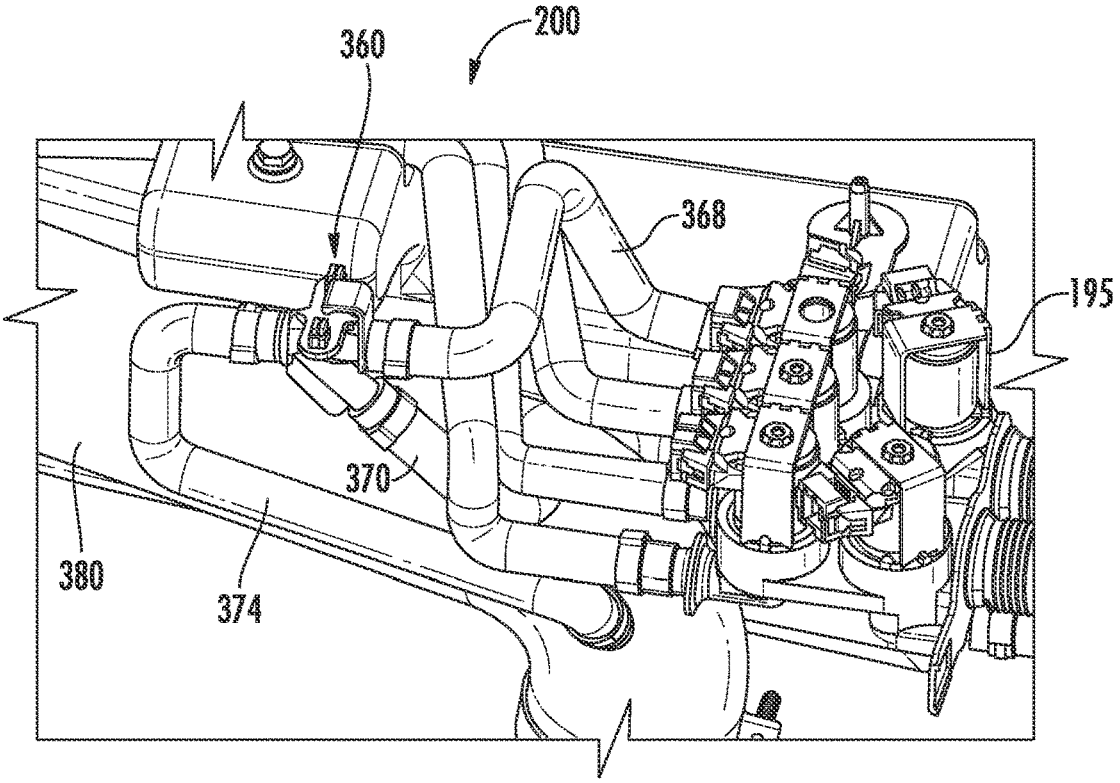
FIG. 8 provides a perspective view of a dispenser system according to exemplary embodiments of the present disclosure.
Figure 9:
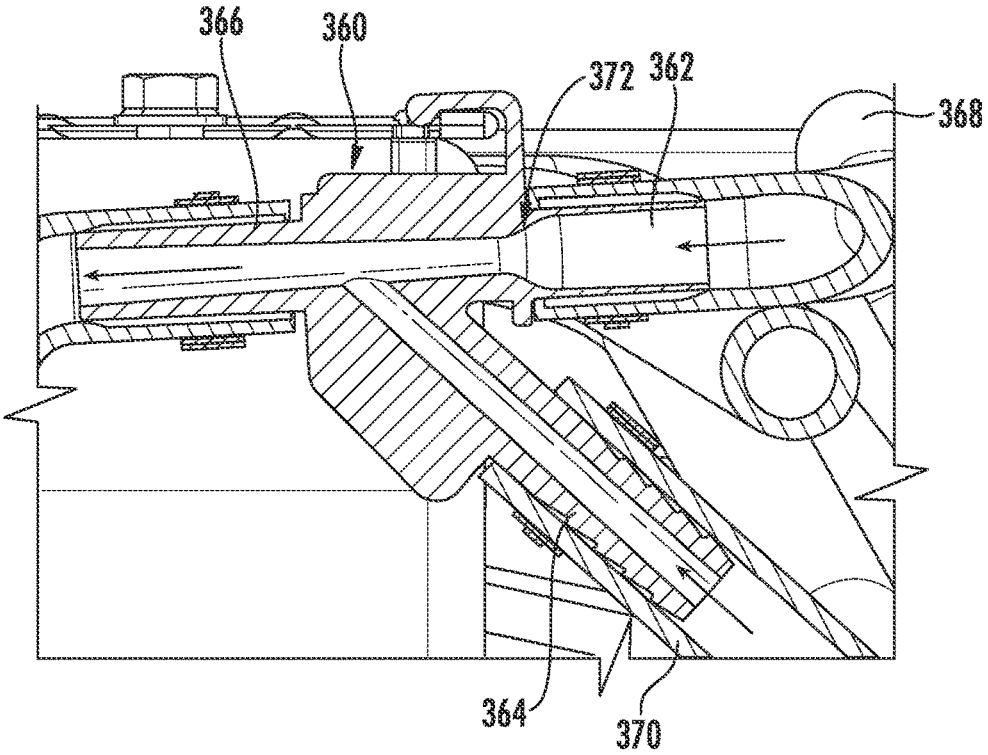
FIG. 9 provides a side schematic view of the exemplary dispenser system of FIG. 8.

According to at least one alternate embodiment, a pump for selectively directing or delivering fluid additive FA from first tank 300 to the tub 114 will be described with reference to FIGS. 8 and 9. For purposes of this disclosure, a single pump will be described, however it should be understood that multiple pumps may be incorporated into specific embodiments. For instance, each of first drawer assembly 250 and second drawer assembly 280 may include a respective pump or pump assembly. Accordingly, dispenser assembly 200 also includes one or more pumps. That is, either pump is configured to draw additive from either first tank 300 or second tank 302 such that it may ultimately be delivered to or dispensed into tub 114 for treating articles disposed within tub 114. For this embodiment, each pump is a Venturi pump or aspirator 360. In alternative embodiments, however, each pump may be an electric pump or other suitable pump for directing fluid additive from first tank 300 to tub 114, or any suitable combination of pumps. Hereinafter, a single pump, aspirator 360, and the first tank 300 will be referred to. However, the description will apply to each of first tank 300 and second tank 302.

Aspirator 360 produces a vacuum by means of the Venturi effect to draw fluid additive from first tank 300. In particular, as shown best in FIG. 9, aspirator 360 includes an inlet port 362, a suction port 364, and a discharge port 366. Inlet port 362 of aspirator 360 may be in fluid communication with water inlet valve 195 (FIG. 8) via a water supply line 368. Water inlet valve 195 may be communicatively coupled with controller 180 (FIG. 2). In this way, controller 180 may selectively control the designated valve of water inlet valve 195 to open or close to control the flow rate and volume of water flowing into inlet port 362 of aspirator 360, e.g., to achieve the desired vacuum to draw a controlled amount of fluid additive from first tank 300. Suction port 364 of aspirator 360 may be in fluid communication with first tank 300 via a suction line 370. When water is directed through a Venturi nozzle 372 of inlet port 362, the pressure of the water flowing through the constricting section of Venturi nozzle 372 decreases and the velocity of the water increases. The decreased pressure of the water downstream of the constricting section creates a vacuum that pulls or draws fluid additive from first tank 300 to suction port 364 of aspirator 360. Thus, the amount of fluid additive dispensed into tub 114 may be controlled by adjusting the water flow through inlet port 362 of aspirator 360. Discharge port 366 may be in fluid communication with tub supply conduit 380 (and ultimately tub 114) via a discharge line 374 as shown best in FIG. 8. The mixture of water from inlet port 362 and fluid additive from suction port 364 forms wash fluid. The wash fluid may exit aspirator 360 through discharge port 366 and flows downstream to tub supply conduit 380 via discharge line 374. When the mixture of water and fluid additive (or wash fluid) reaches tub supply conduit 380, the wash fluid may mix with wash fluid flowing downstream from one or more of the additive compartments 256, 258, 260 of drawer assembly 250 (FIG. 3). Finally, the mixture of wash fluid may be dispensed or directed into tub 114 through spout 130 of tub supply conduit 380, e.g., as shown in FIG. 2.

Laundry treatment appliance 100 disclosed herein provides a number of advantages. For instance, the large capacity of first tank 300 allows users to run a multitude of wash cycles without need to refill first tank 300 after each cycle. Further, as first tank 300 is positioned at or adjacent a top portion of cabinet 102, space below the tub 114 may be utilized for other uses, such as e.g., machinery to drive basket 120 or drain tub 114. In addition, the second tank 302 and second drawer 280 may provide additional bulk storage of additives, which may be used in a washing operation or a drying operation. As will be appreciated, the exemplary embodiments of laundry treatment appliance 100 described herein may have other advantages and benefits.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A laundry treatment appliance defining a vertical direction, a lateral direction, and a transverse direction, the laundry treatment appliance configured to perform a washing operation and a drying operation, the laundry treatment appliance comprising:

a cabinet forming a receiving space therein;

a tub provided within the receiving space; and a dispenser assembly provided within the receiving space, the dispenser assembly being in fluid communication with the tub, the dispenser assembly comprising:

a dispenser body coupled to the cabinet and provided adjacent to the tub, the dispenser body defining a front face and a rear face;

a first drawer slidably inserted into the dispenser body along the transverse direction between a withdrawn position and a retracted position;

a second drawer slidably inserted into the dispenser body along the transverse direction between a withdrawn position and a retracted position, the second drawer being provided beneath the first drawer along the vertical direction, wherein a rear end of the first drawer is provided behind a rear end of the second drawer along the transverse direction when each of the first drawer and the second drawer are in the retracted position; and an outlet defined at a lower portion of the dispenser body, the outlet protruding from the front face of the dispenser body and facing toward a front of the cabinet, wherein contents from each of the first drawer and the second drawer exit the dispenser body via the outlet, wherein the first drawer and the second drawer are immediately adjacent to each other, and wherein a length of the front face from a top edge of the dispenser body to a bottom edge of the dispenser body is greater than a length of the rear face along the vertical direction from the top edge of the dispenser body to the bottom edge of the dispenser body.

2. The laundry treatment appliance of claim 1, wherein the first drawer comprises:

a first drawer body defining a plurality of cups therein, the first drawer body having a first length along the transverse direction; and a first tank nested within the first drawer body, the first tank having a first volume and being configured to hold a liquid.

3. The laundry treatment appliance of claim 2, wherein the first tank is provided behind the plurality of cups along the transverse direction.

4. The laundry treatment appliance of claim 2, wherein the second drawer comprises:

a second drawer body having a second length along the transverse direction; and a second tank nested within the second drawer body, the second tank having a second volume.

5. The laundry treatment appliance of claim 4, wherein the first length is greater than the second length, and the first volume is greater than the second volume.

6. The laundry treatment appliance of claim 4, further comprising:

a first Venturi nozzle fluidly connected to the first tank; and a second Venturi nozzle fluidly connected to the second tank.

7. The laundry treatment appliance of claim 6, further comprising:

a water supply valve; and a controller operatively connected to the water supply valve, wherein the controller is configured to selectively supply water from the water supply valve to at least one of the first Venturi nozzle or the second Venturi nozzle according to a predetermined schedule.

8. The laundry treatment appliance of claim 1, wherein the first drawer and the second drawer are retractable from the front face along the transverse direction.

9. The laundry treatment appliance of claim 1, wherein the laundry treatment appliance is a front load laundry treatment appliance.

10. A laundry treatment appliance defining a vertical direction, a lateral direction, and a transverse direction, the laundry treatment appliance comprising:

a cabinet forming a receiving space therein;

a tub provided within the receiving space; and a dispenser assembly provided within the receiving space, the dispenser assembly being in fluid communication with the tub, the dispenser assembly comprising:

a dispenser body coupled to the cabinet and provided adjacent to the tub, the dispenser body having a wedge shape along the transverse direction from a front face toward a rear face thereof;

a first drawer slidably inserted into the dispenser body along the transverse direction into the front face between a withdrawn position and a retracted position;

a first supply conduit selectively allowing fluid contained within the first drawer to flow into the dispenser body;

a second drawer slidably inserted into the dispenser body along the transverse direction into the front face between a withdrawn position and a retracted position, the second drawer being provided beneath the first drawer along the vertical direction wherein a rear end of the first drawer is provided behind a rear end of the second drawer along the transverse direction when each of the first drawer and the second drawer are in the retracted position;

a second supply conduit selectively allowing fluid contained within the second drawer to flow into the dispenser body, wherein the fluid contained within the first drawer flows into the dispenser body without passing through the second drawer; and an outlet defined at a lower portion of the dispenser body, the outlet protruding from the front face of the dispenser body and facing toward a front of the cabinet, wherein contents from each of the first drawer and the second drawer exit the dispenser body via the outlet, and wherein a length of the front face from a top edge of the dispenser body to a bottom edge of the dispenser body is greater than a length of the rear face along the vertical direction from the top edge of the dispenser body to the bottom edge of the dispenser body.

11. The laundry treatment appliance of claim 10, wherein the first drawer comprises:

a first drawer body defining a plurality of cups therein, the first drawer body having a first length along the transverse direction; and a first tank nested within the first drawer body, the first tank having a first volume and being configured to hold a liquid, wherein the first supply conduit is in fluid communication with the first tank.

12. The laundry treatment appliance of claim 11, wherein the first tank is provided behind the plurality of cups along the transverse direction.

13. The laundry treatment appliance of claim 11, wherein the second drawer comprises:

a second drawer body having a second length along the transverse direction; and a second tank nested within the second drawer body, the second tank having a second volume, and wherein the second supply conduit is in fluid communication with the second tank.

14. The laundry treatment appliance of claim 13, wherein the first length is greater than the second length, and the first volume is greater than the second volume.

15. The laundry treatment appliance of claim 13, further comprising:

a water supply valve; and a controller operatively connected to the water supply valve, wherein the controller is configured to selectively mix water from the water supply valve with contents of at least one of the first tank or the second tank according to a predetermined schedule.

16. The laundry treatment appliance of claim 10, wherein the laundry treatment appliance is a front load laundry treatment appliance.

* * * * *